United States Patent [19]

Shibayama et al.

[11] 4,004,999

[45] Jan. 25, 1977

[54] PROCESS FOR PREPARING A COATED PRODUCT

[75] Inventors: Kyoichi Shibayama; Fumihiko Sato; Takashi Takahama, all of Amagasaki, Japan

[73] Assignee: Mitsubishi Denki Kabushiki Kaisha, Tokyo, Japan

[22] Filed: Apr. 3, 1975

[21] Appl. No.: 564,908

[30] Foreign Application Priority Data

Apr. 30, 1974 Japan ..... 49-49012
Apr. 30, 1974 Japan ..... 49-49013

[52] U.S. Cl. ..... 204/181; 204/300 EC
[51] Int. Cl.[2] ..... C25D 13/06; C25D 13/16
[58] Field of Search ..... 204/181

[56] References Cited

UNITED STATES PATENTS 3,640,810 2/1972 Plasynski et al. ..... 204/181

*Primary Examiner*—Howard S. Williams
*Attorney, Agent, or Firm*—Oblon, Fisher, Spivak, McClelland & Maier

[57] ABSTRACT

Coated products are prepared by electrodepositing a varnish from a water dispersion onto a conductive substrate; dipping said coated substrate into hot water so that the varnish is treated with said hot water; and thereafter treating said varnish coating with compressed steam.

4 Claims, 2 Drawing Figures

PROCESS FOR PREPARING A COATED PRODUCT

BACKGROUND OF THE INVENTION

1. Field of the Invention

The present invention relates to a novel process for preparing a coated product by electrodeposition of a water-dispersion varnish.

2. Description of the Prior Art

Heretofore, it has been well-known to use electrodeposition for the formation of a cured synthetic resin film onto a conductive substrate. There are two such processes: electrodeposition of a water soluble varnish and electrodeposition of a water dispersion varnish. In the former process, the substrate is conductive and is the anode for deposition of the water soluble varnish. The deposited layer usually has insulating properties. Accordingly, the thickness of the electrodeposited layer is limited and the process is not suitable for the preparation of a cured synthetic resin coated insulation product. On the other hand, in the latter process for electrodeposition, the substrate is again the anode but the deposition is of a water-dispersion varnish. The material in the layer is deposited in the form of particles with spaces in between whereby the conductive substrate is not insulated, allowing an increase in thickness of the deposited layer. When the layer deposited in the water-dispersion varnish case is cured, many of the particles in the deposited layer will be adhered to each other. However, it is difficult to form a continuous film which is free of cracks and imperfections. In order to overcome these disadvantages, it has been proposed to treat the coating with a hydrophilic organic solvent following the electrodeposition (Japanese Patent Publication No. 31555/1970). It has been also proposed to place a coating of an insulation varnish after the electrodeposition of the water-dispersion varnish (Japanese Patent Publication No. 51096/1972), and to electrodeposit a water soluble varnish after the electrodeposition of a water-dispersion varnish (Japanese Patent Publication Nos. 5247/1973; 9456/1973 and 43708/1973). Another proposed solution is contained in Japanese Patent Publication No. 4604/1973.

In the conventional processes, various film forming auxiliary agents have been applied. In general, the film forming auxiliary agent produces a toxic solvent gas during the curing operation. Accordingly, it has been undesirable to discharge the solvent gas into the air. This is also unwarranted from the viewpoint of loss of solvent. It is, therefore, necessary to have additional solvent recovery equipment, although the processes so far proposed, e.g., Japanese Patent Publication No. 31555/1970, do contain somewhat favorable features which enable simple and effective solvent recovery. When an insulation layer having a thickness of more than 100$\mu$m is formed by electrodeposition, it has been necessary to apply a curing step or a heat curing step by elevation of temperature after treating the coated layer with the film forming auxiliary agent, whereby the curing operation becomes complicated.

In general, in the past, an insulation varnish coated wire has been prepared by either of the following processes. A bare wire is dipped into a varnish tank and the amount of coated varnish is controlled to a desired amount by passage through a floating die, etc. The coated wire is then cured. These steps are repeated several times to form a coated film having the desired thickness. Alternatively, a water soluble or water-dispersion synthetic resin varnish is deposited onto a conductive wire by electrophoresis to form a coated film having uniform thickness. In the latter case, the process has been advantageously easy. However, it has been difficult to obtain a continuous film having high insulation intensity using the conventional electrodeposition processes. Accordingly, it has been necessary to use a film forming auxiliary agent in order to obtain a continuous film having high insulation intensity using electrodeposition with a water-dispersion varnish. It has been necessary to apply a water washing tank and a post-treatment tank between the electrodeposition equipment used to deposit water-dispersion varnish onto the conductive wire and the curing equipment.

Additionally, it has been known to coagulate deposited latex particles by electrodepositing a water-dispersion varnish and boiling the coated layer. However, it has been difficult to obtain a smooth surface. Also, the process has not been suitable for preparing a coated wire by the electrodeposition of water dispersion varnish. An insulation coated wire to be used for a magnet coil is generally coated with grease in order to enable smooth winding. Since the smoothness of the coated film has a close relationship with the appearance, the existence of pin holes in the coated film, the abrasion resistance, the flexibility and the durability of the wire, any process producing an unsmooth product is inapplicable.

It would be most desirable to have a process for producing an insulating coating which is free from the aforementioned disadvantages.

SUMMARY OF THE INVENTION

Accordingly, it is one object of the present invention to provide a process for preparing a novel coated product by overcoming the disadvantages of the conventional processes thereby saving energy, preventing pollution and conserving raw materials.

It is another object of this invention to provide a process for preparing an insulation coated wire having uniform and excellent characteristics which overcomes the above-mentioned disadvantages and enables coating at high speeds. It is still another object of this invention to provide an apparatus for preparing the coated product.

Briefly, these and other objects of this invention as will hereinafter become apparent by the discussion below have been attained by providing a process for preparing a coated product which comprises electrodepositing a varnish from a water dispersion onto a conductive substrate; dipping said coated substrate into hot water so that the varnish is treated with said hot water; and thereafter treating said varnish coating with compressed steam.

The apparatus of the invention comprises an electrodeposition bath, a hot water bath, and a compressed steam treating device to improve the leveling of the coagulated electrodeposited film, whereby a continuous film having the desired properties is formed without using an organic solvent.

DETAILED DESCRIPTION OF THE PREFERRED EMBODIMENTS

Figure 1:
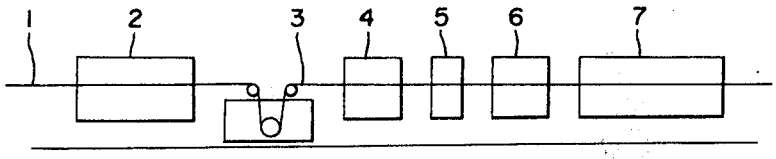
FIG. 1 is a schematic view of the system for preparing a water-dispersion varnish coated wire according to the invention.

In the process for preparing a coated product of this invention, a water-dispersion varnish is electrodeposited onto a conductive substrate. The product is passed through hot water maintained at a temperature higher than the minimum film forming temperature of the water-dispersion varnish. Then, compressed steam heated to a temperature higher than the boiling point of water is sprayed onto the coated layer by a spray gun in order to form a semicured film. The film is then cured by drying. The drag-out varnish adhered to the electrodeposited layer can be washed off and simultaneously the coagulation of the precipitated particles of the varnish can be promoted thereby partially forming a film in the first hot water treatment. The particles are then melted by the compressed steam spray to form a continuous film having a smooth and lustrous surface. The temperature of the steam is dependent upon the formula of the varnish, but is preferably higher than 120° C. In general, the water content in the deposited layer formed by the electrodeposition of a water-dispersion varnish is about 50% by weight which is significantly higher than that of a water soluble varnish. The electrodeposited layer is relatively soft.

If compressed steam is sprayed onto the coated layer after the electrodeposition, the surface of the coated layer disadvantageously becomes uneven or water contained in the deposited layer is rapidly heated, causing bumps and foaming. The duration time for the hot water treatment and the steam treatment are dependent upon the thickness of the electrodeposited layer. When the electrodeposited layer has a thickness of 30–50$\mu$m, a coated film having a smooth and lustrous surface can be formed by treatment in hot water for about 1–2 seconds and in compressed steam for about 1–2 seconds. The treatment time for the hot water treatment and the compressed steam treatment can be longer. It is possible to raise the temperature of the steam applied so as to both dry and cure the electrodeposited layer. Accordingly, with the hot water treatment and the steam treatment, the final curing can be attained without a semicuring step. When the temperature for the hot water treatment is lower than the minimum film forming temperature, water in the deposited layer is unsatisfactorily removed and the melt-adhesion of the particles is unsatisfactorily effected whereby the desired continuous film cannot be obtained.

Suitable varnishes used for the process of the invention are listed below, together with the suitable temperature of the compressed steam:

The monomers are polymerized to produce the water-dispersion varnish.

| | | |
|---|---|---|
| (a) | Acryl type varnish | wt. parts |
| | styrene | 45 |
| | ethylacrylate | 45 |
| | glycidyl methacrylate | 5 |
| | methacrylic acid | 5 |
| (b) | Acryl type varnish | wt. parts |
| | styrene | 25 |
| | acrylonitrile | 25 |
| | ethyl acrylate | 50 |
| (c) | Epoxy type varnish | wt. parts |
| | bisphenol type epoxy resin | 77 |
| | ethylene glycol | 3 |
| | tetrahydrophthalic anhydride | 20 |
| (d) | Styrene type varnish | wt. parts |
| | styrene | 50 |
| | ethyl acrylate | 50 |

Suitable temperatures of the compressed steam for the above varnishes are as follows:

| | |
|---|---|
| (a) | 100 – 140° C |
| (b) | 100 – 140° C |
| (c) | 110 – 150° C |
| (d) | 100 – 150° C |

Suitable temperatures of the compressed steam for the above varnishes are as follows:

a. 100° – 140° C
b. 100° – 140° C
c. 110° – 150° C
d. 100° – 150° C

Having generally described the invention, a more complete understanding can be obtained by reference to certain specific examples, which are included for purposes of illustration only and are not intended to be limiting unless otherwise specified. Throughout the examples, the terms "part" and "percent" refer to part by weight and percent by weight.

REFERENCE EXAMPLE 1

A bare copper wire having a diameter of 1 mm was treated with 2N $HNO_3$ and then was washed with water. The wire was dipped into an acryl type water-dispersion varnish. (This varnish consisted of 25 wt parts of styrene, 25 wt parts of acrylonitrile, 50 wt parts of ethyl acylate, 200 wt parts of deionized water, 2 wt parts of sodium laurylsulfate, 0.1 wt part of potassium persulfate and 0.033 wt part potassium hydrogen sulfate. The mixture was stirred for 15 – 30 minutes in a nitrogen atmosphere. It then was stirred at 50° – 60° C for 4 hours to react the components, whereby a water-dispersion varnish was obtained.) A DC voltage (4 volts) was applied for 2 seconds using the wire as an anode for the electrodeposition. The product was dipped into boiling water for 1 – 2 seconds and then was heated at 200° C for 1 hour to cure the coated layer. An insulated wire coated with a film having a thickness of about 30$\mu$m and no luster was obtained.

REFERENCE EXAMPLE 2

In a reactor, 45 wt parts of styrene, 45 wt parts of ethyl acrylate, 5 wt parts of glycidyl methacrylate, 5 wt parts of methacrylic acid, 200 wt parts of deionized water, 2 wt parts of sodium laurylsulfate, 0.1 wt part of potassium persulfate and 0.033 wt part of potassium hydrogen sulfate were charged. The mixture was stirred for 30 minutes in a nitrogen atmosphere, and then was stirred at 50° – 60° C for 4 hours to react the components, whereby a water-dispersion varnish was obtained. A washed copper plate having a size of 5 cm × 5 cm × 1 mm was dipped into the water-dispersion varnish and a DC voltage (5 volts) was applied for 5 seconds using the plate as the anode for the electrodeposition. The product was treated by compressed steam at 120° C for 3 seconds. The resulting film had an uneven surface and a porous structure. A uniform film was not formed.

REFERENCE EXAMPLE 3

The copper plate having the electrodeposited layer of Reference 2 was dipped into N,N-dimethyl formamide for 5 seconds. The product was heated at 80° C for 1 hour to semicure it and was further heated at 200° C for 1 hour to cure it whereby an insulation film having a thickness of 100$\mu$m and a lustrous surface was obtained. The dielectric breakdown strength was 8.5 KV and the insulation resistance was $7 \times 10^{15}\Omega$-cm. When the semicuring step, heating at 80° C for 1 hour, was omitted in the process and the product was instead directly heated to 200° C for 1 hour to cure it, the resulting film had an unacceptably rough surface.

EXAMPLE 1

The wire having the electrodeposited layer of Reference 1 was dipped into boiling water for 1 – 2 seconds and then treated by compressed steam at 120° C for 1 – 2 seconds. It was then cured at 200° C for 1 hour. An insulated wire coated with a film having a thickness of about 30μm and a smooth and lustrous surface was obtained.

EXAMPLE 2

The copper plate having the electrodeposited layer of Reference 2 was dipped into boiling water for 2 – 3 seconds and then treated by compressed steam at 120° C for 3 – 5 seconds. It was then cured at 200° C for 1 hour. An insulated plate coated with a film having a thickness of about 100μm and a smooth and lustrous surface was obtained. The dielectric breakdown strength was 8 KV and the insulation resistance was $1 \times 10^{16}\Omega$–cm.

TABLE 1

| | Reference 1 | Example 1 |
|---|---|---|
| Diameter of wire (mm) | 1 | 1 |
| Thickness of film (μm) | 28–31 | 29–31 |
| Appearance | Non-lustrous | Lustrous |
| Pin holes (dots/5m) | 6 | 0 |
| Dielectric breakdown strength (two wire twist) (KV) | 5.2 | 11.2 |
| Abrasion resistance (times) | 8 | 52 |
| Winding property | Bad, even for a circle with a diameter 9 times its own | Good, even for a circle with a diameter that equals its own |
| Surface | Cracked | Smooth |

In accordance with the invention, a film having uniform and excellent characteristics can be obtained without pollution problems in low cost and low energy consumption. One embodiment of the invention for forming an insulated film on a wire will be illustrated.

FIG. 1 is a schematic view of a system used for the process of the invention. The reference numeral 1 designates a conductive metal wire; 2 designates an annealing furnace; 3 designates a pretreatment vessel; 4 designates an electrodeposition bath; 5 designates a boiling water bath; 6 designates a compressed steam treating device; and 7 designates a drying and curing furnace. The electrodeposition bath 5 and the boiling water bath 6 are arranged in a horizontal linear line. In the system, the conductive metal wire 1 for coating with an insulation film is passed through the annealing furnace 2 in order to anneal it so as to improve its properties for processing. The surface is cleaned by passing through the pretreatment vessel 3 and the metal wire 1 is dipped into the electrodeposition bath 4 filled with a water dispersion varnish. The metal wire having the coated layer formed by electrodepositing in the electrodeposition bath 4 is then passed through the boiling water bath thereby forming a strong layer [on the conductive metal wire 1] which is not deformed nor damaged when touched by the guide roll. Accordingly, that portion of the process wherein the wire must be linear is much shorter as compared to the conventional process. Thereby swinging of the wire can be prevented. The metal wire 1 having the resin coated layer is then passed through the compressed steam treating device 6 to heat and compress it, whereby a coated layer having excellent leveling and luster can be formed. The product is then passed into the drying and curing furnace 7 to finally cure the coated layer whereby an insulation film having excellent surface characteristics can be formed on the metal wire 1.

Figure 2:
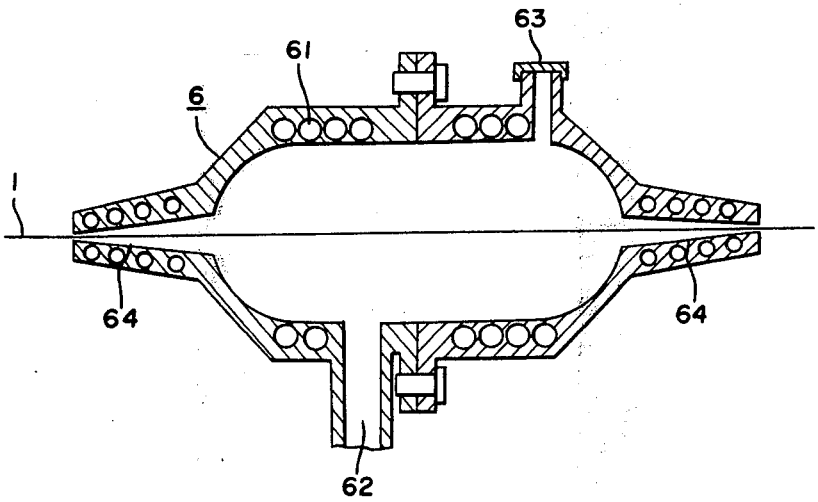
FIG. 2 is a sectional view of a compressed steam treating device according to the invention.

Referring to FIG. 2, the compressed steam treating device 6 will be further illustrated. In this figure, the reference 1 designates a conductive metal wire which has been treated by boiling water after the electrodeposition of the water-dispersion varnish; 6 designates a device for heating with compressed steam; 61 designates a heater for heating steam; 62 designates a steam inlet and 63 designates a safety valve. The compressed steam fed from the steam inlet 62 is fed into the device for heating with compressed steam 6 and is heated by the heater 61. The heated and compressed steam is discharged from the nozzles 64 which are located at the inlet and the outlet of the conductive metal wire 1. The coated layer on the conductive metal wire 1 is heated and compressed by the steam to form a continuous film having a smooth and lustrous surface. The advantage of the apparatus according to this invention is its simple structure. Furthermore, the system can be used with either a low speed or a high speed by selecting an approximate length and diameter by the nozzles 64. The system can be combined with any other conventional electrodeposition steps in order to prepare a wire coated with an effective insulation film.

REFERENCE EXAMPLE 4

The water-dispersion varnish of Reference 2 was fed to an electrodeposition bath having a length of 50 cm. A bare copper wire having a diameter of 0.5 mm was passed through the varnish at a rate of 20 m/min while applying a DC voltage (2 volts). The product was dipped into the boiling water bath for 3 seconds and then was heated to cure the coated layer. An insulated wire coated with a film having a thickness of about 25μm was obtained.

REFERENCE EXAMPLE 5

A bare copper wire was passed through the varnish at a rate of 60 m/min while applying a DC voltage (6 volts) in accordance with Reference 4. The product was dipped into the boiling water bath for 1 second, and then was heated to cure the coated layer. An insulated wire coated with a film having a rough surface and an undesirable appearance was obtained.

REFERENCE EXAMPLE 6

A bare copper wire was passed through the varnish at a rate of 20 m/min while applying a DC voltage (2 volts) in accordance with Reference 4. The product was dipped into N,N-dimethyl formamide for 1 second and then was heated to cure the coated layer. An insulated wire coated with a film having a thickness of about 26μm was obtained. The amount of N,N-dimethyl formamide to be recovered was quite high.

REFERENCE EXAMPLE 7

A bare copper wire was passed through the varnish at a rate of 60 m/min while applying a DC voltage (6 volts) in accordance with Reference 4. The product was dipped into N,N-dimethyl formamide for 0.3 seconds and then was heated to cure the coated layer. An insulated wire coated with a film having thickness of about 23μm was obtained. The amount of N,N-dimethyl formamide to be recovered was rather high.

EXAMPLE 3

A bare copper wire was passed through the varnish at a rate of 60 m/min while applying a DC voltage (6 volts) in accordance with Reference 4. The product was dipped into the boiling water bath for 1 second and then was treated in the compressed steam treating device for 0.5 seconds and was dried. An excellent insulated wire coated with a film having a thickness of about 24μm was obtained. The characteristics of the wires prepared in accordance with References 4, 5, 6, 7 and Example 3 are shown in Table 2.

TABLE 2

| | Reference 4 | Reference 5 | Reference 6 | Reference 7 | Example 3 |
|---|---|---|---|---|---|
| Diameter of wire (mm) | 0.5 | 0.5 | 0.5 | 0.5 | 0.5 |
| Thickness of film (μm) | 25 | 22–28 | 26 | 23 | 24 |
| Appearance | rough | cracked uneven | smooth luster | smooth luster | smooth luster |
| Pin hole (dots/5m) | 10 | large number | 0 | 0 | 0 |
| Dielectric breakdown Strength (Two wire twist) (KV) | 3.5 | — | 9.6 | 7.8 | 8.3 |
| Winding property | bad, even for a circle whose diameter is five times its own | — | good, even for a circle whose diameter is equal to its own | good, even for a circle whose diameter is equal to its own | good, even for a circle whose diameter is equal to its own |
| Abrasion resistance (times) | 7 | — | 42 | 28 | 36 |
| Heat shock (180° C 1 hour) | bad, even for a circle whose diameter is five times its own | — | good, even for a circle whose diameter is equal to its | good, even for a circle whose diameter is equal to its own | good, even for a circle whose diameter is equal to its own |
| N,N-Dimethyl formamide amount to be recovered | 0 | 0 | quite heavy | rather heavy | 0 |

In accordance with the invention, a wire coated with an insulation film having a uniform thickness and excellent characteristics can be obtained. Moreover, in accordance with the invention, a wire coated with an insulation film having a uniform thickness and excellent characteristics can be prepared in high speed by using a simple apparatus.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A process for preparing a coated product which comprises electrodepositing a varnish from a water dispersion onto a conductive substrate; dipping said coated substrate into hot water so that the varnish is treated with said hot water; and thereafter treating said varnish coating with compressed steam.

2. The process of claim 1, wherein said hot water is at a temperature which is higher than the minimum film forming temperature.

3. The process of claim 1, wherein said varnish is semi-cured by said steam and hot water treatments, and, wherein said cure is completed by subsequent drying.

4. The process of claim 1, wherein the water-dispersion varnish comprises styrene, ethylacrylate, glycidyl methacrylate, methacrylic acid, acrylonitrile, bisphenol type epoxy resin, ethylene glycol or tetrahydrophthalic anhydride.

* * * * *